US007326123B2

(12) United States Patent
Park

(10) Patent No.: US 7,326,123 B2
(45) **Date of Patent: *Feb. 5, 2008**

(54) GOLF SWING TRAINING DEVICE

(76) Inventor: Othili Park, 40 Providence St., West Warwick, RI (US) 02893

( * ) Notice: Subject to any disclaimer, the term of this patent is extended or adjusted under 35 U.S.C. 154(b) by 0 days.

This patent is subject to a terminal disclaimer.

(21) Appl. No.: 11/291,123

(22) Filed: Nov. 30, 2005

(65) Prior Publication Data

US 2006/0073946 A1 Apr. 6, 2006

Related U.S. Application Data

(62) Division of application No. 10/830,723, filed on Apr. 23, 2004, now Pat. No. 6,991,553.

(60) Provisional application No. 60/483,986, filed on Jun. 30, 2003, provisional application No. 60/473,569, filed on May 27, 2003, provisional application No. 60/472,586, filed on May 22, 2003, provisional application No. 60/467,018, filed on May 1, 2003, provisional application No. 60/468,756, filed on May 8, 2003.

(51) Int. Cl.
*A63B 69/36* (2006.01)
*A63B 21/06* (2006.01)

(52) U.S. Cl. ..... 473/256; 482/93; 482/110; 473/212; 473/219

(58) Field of Classification Search ..... 473/207, 473/212, 213, 219, 256, 424, 425, 437, 457, 473/595, 596, 615; 482/92, 93, 105–110, 482/148

See application file for complete search history.

(56) References Cited

U.S. PATENT DOCUMENTS

| | | | | |
|---|---|---|---|---|
| 777,478 | A | 12/1904 | Minor | 482/93 |
| 2,115,926 | A * | 5/1938 | Hatton | 473/596 |
| 3,069,162 | A | 12/1962 | Samuel | 482/110 |
| 3,100,353 | A | 8/1963 | Chamberlin | 434/141 |
| 4,077,625 | A * | 3/1978 | Clarke | 482/92 |
| 4,321,888 | A | 3/1982 | Topliffe | 119/709 |
| 4,726,357 | A | 2/1988 | DeStefano | 601/41 |
| 4,846,464 | A | 7/1989 | Jorno | 272/119 |
| 5,127,648 | A * | 7/1992 | Mallick | 473/596 |
| 5,181,325 | A | 1/1993 | Damon | 33/510 |
| 5,230,682 | A | 7/1993 | Myers | 482/122 |
| 5,242,348 | A | 9/1993 | Bates | 482/105 |
| 5,282,777 | A | 2/1994 | Myers | 482/122 |
| 5,407,193 | A | 4/1995 | McGinley | 473/451 |
| 5,547,195 | A * | 8/1996 | Callanan | 473/227 |
| 5,735,776 | A | 4/1998 | Swezey et al. | 482/91 |
| 5,810,700 | A | 9/1998 | Orcutt | 482/123 |

(Continued)

OTHER PUBLICATIONS

Flaghouse Hemisphere Playground Ball, Recreation, Sports & Play catalog, Fall 2001, p. 96.*

*Primary Examiner*—Kevin C. Sirmons
*Assistant Examiner*—Victor K. Hwang
(74) *Attorney, Agent, or Firm*—Sturm & Fix LLP

(57) ABSTRACT

A training device for strengthening the swing muscle groups of a golfer while enhancing proper muscle memory, wherein the device includes a hollow ball having a meridian line that divides the ball into two visually distinct hemispheres, and further including a pair of elongated slots for receiving the user's fingers, each of the pair of slots being disposed on opposite sides of and angled toward the meridian line to insure the proper relative positioning of the user's hands.

11 Claims, 8 Drawing Sheets

U.S. PATENT DOCUMENTS

| | | | | |
|---|---|---|---|---|
| 5,839,968 | A | 11/1998 | Latella | 473/219 |
| 6,003,470 | A * | 12/1999 | Budman | 119/711 |
| 6,068,580 | A | 5/2000 | Myers et al. | 482/93 |
| 6,176,790 | B1 * | 1/2001 | Latella | 473/219 |
| 6,547,703 | B1 | 4/2003 | Swezey et al. | 482/91 |
| 6,622,659 | B2 * | 9/2003 | Willinger | 119/702 |
| D494,233 | S | 8/2004 | Kerry | D21/662 |
| D498,799 | S | 11/2004 | Kerry | D21/662 |
| D503,756 | S | 4/2005 | Chiang | D21/662 |
| 7,044,820 | B2 * | 5/2006 | Ladisa | 441/81 |
| 2003/0181266 | A1 * | 9/2003 | Sowders | 473/447 |
| 2005/0250627 | A1 * | 11/2005 | Park | 482/93 |

* cited by examiner

GOLF SWING TRAINING DEVICE

CROSS REFERENCE TO RELATED APPLICATIONS

This invention was the subject matter of Provisional Patent Application Ser. No. 60/467,018, filed in the United States Patent and Trademark Office on May 1, 2003; Ser. No. 60/468,756, filed May 8, 2003; Ser. No. 60/472,586, filed May 22, 2003; Ser. No. 60/473,569, filed May 27, 2003; and Ser. No. 60/483,986, filed Jun. 30, 2003; and this application is a Divisional Application of Nonprovisional Patent Application Ser. No. 10/830,723, filed Apr. 23, 2004, now U.S. Pat. No. 6,991,553, issued Jan. 31, 2006.

BACKGROUND OF THE INVENTION

1. Field of the Invention

The present invention relates to the field of sports oriented swing training devices in general and in particular to a golf swing training device which also strengthens the golfer's swing muscle groups.

2. Description of Related Art

As can be seen by reference to the following U.S. Pat. Nos. 4,846,464; 5,242,348; 5,735,776; and, 5,230,682, the prior art is replete with myriad and diverse generally ball shaped exercise and swing training arrangements.

While all of the aforementioned prior art constructions are more than adequate for the basic purpose and function for which they have been specifically designed, they are uniformly deficient with respect to their failure to provide a simple, efficient, and practical golf swing training device that not only enhances the muscle memory of a correct golf swing, but which also strengthens the abdominal and back muscles utilized in a proper swing.

As with most physical games that include physical strength, as well as, mental components, the golf club swing is a major element in the game of golf, i.e., the strength of one's body that enables the swinging activity to be accomplished to a great extent affects the ability of one's skill level in that game. Accordingly, golfers have commonly worked on torso and core strengthening exercises that contribute to the strength on one's swing in order to increase impact power while maintaining a controlled rhythm. This includes the grasping and swinging in a golf swing motion relatively heavy weighted balls in the order of four to ten pounds commonly referred to as medicine balls. The swinging of such medicine balls is an effective exercise to strengthen the muscles used in a golf swing, especially in the upper and lower torso. However, unless the medicine ball is released at the end of the swing motion which, of course, necessitates a fairly large exercise area and preferably in a gym or an outdoor environment, the hands and arms must necessarily exert a grasping action on the ball in the direction opposite to the swing motion that reduces the benefit of the exercise.

The benefits of this form of exercise are well recognized and, in fact, utilized by professional and advanced golfers in teams of two wherein, either a single medicine ball or a pair thereof are tossed back and forth during the swing exercise by the individual players to the other partner, so as to substantially reduce the amount of time and effort required to retrieve the practice ball if one person alone was performing the exercise in the intended manner, that is, grasping and swinging the ball in the swing attitude and then releasing the ball at the end of the swing motion. In light of the space and practical need for a pair of exercisers to perform this exercise together, there is a need for an improved medicine ball which can be used for golf practice swing exercise in which the ball is not physically released at the end of the swing yet the hands and arms in the swinging motion do not have to exert a grasping force on the ball in the direction opposite to the swing motion thus permitting the full benefit of the exercise to be achieved in a relatively small space and by a solo exerciser.

Accordingly, the need exists for an improved golf swing ball device in which there is neither a necessity for releasing the ball at the end of the swing nor one in which the swing activity is impaired by the need of grasping the ball in an unnatural manner, that is as related to the swing exercise. In addition, a further object of the present invention is the provision of an exercise device that can be used by a solo participant in a relatively confined space.

A still further objective of the present invention is the provision of a golf swing exercise ball which not only develops the muscles utilized in a golf swing action, but unifies and synchronizes the right blend of arm and body motion which can lead to improved results in terms of fitness, flexibility, strength, and repeatability of the golf swing. The development of a consistent set of muscles basic to the golf swing will result in better prevention of injury in those areas. In addition, it works to develop core muscles along with abdominal muscles and those of the lower back for increased power.

These and other objectives of the present invention are accomplished by the provision of a weighted ball intended to be grasped by both hands of the user and moved in a golf-like swing mode. A key of the invention is that both hands are unified in the swing movement and are themselves held by the ball by way of some means such as an elastic strap under which the hands are inserted. In this way, one hand does not have to oppose the other hand to maintain the mutual ball grasp as in prior exercises and thus enables a more natural swing movement and the support of the ball weight to those muscles that control the golf swing. The invention, although intended for two-hand use, can also be used with one hand. By inserting either hand under the elastic component, the exerciser can utilize the invention to work different muscle groups as determined by the particular exercise.

As a consequence of the foregoing situation, there has existed a longstanding need among both golfers and teaching professionals for a new and improved golf swing training device that can be employed by a single individual in a small amount of space to strengthen their swing muscle groups while ingraining the correct swing motion in their muscle memory, and the provision of such a training device is the stated objective of the present invention.

BRIEF SUMMARY OF THE INVENTION

Briefly stated, the first version of the golf swing training device that forms the basis of the present invention comprises a weighted, generally spherical member having a continuous surface and a hand grasping member disposed on the periphery of the spherical member for properly positioning a golfer's hands on the opposite sides of a meridian that visually divides the external surface of the spherical member into two hemispheres.

As will be explained in greater detail further on in the specification, the spherical member is uniformly weighted and may have either a solid or hollow core wherein, in the preferred embodiment of the invention, the spherical member is hollow and fabricated from a dense, resilient material.

Furthermore, the exterior surface of the spherical member has high coefficient of friction characteristics, as well as, visual indicia that facilitate the positioning of the golfer's hands, focus the golfer's vision on a particular spot and present different visual stimulation during the different phases of the golfer's swing.

In addition, the hand grasping member comprises a permanent anchor element and a releasable anchor element and an elongated resilient strap element that cooperate with one another to maintain different golfers' hands in a relaxed, unstressed condition throughout the address, backswing, downswing, and release phases of a golf swing.

In the second version of the preferred embodiment, the training device is a hollow ball provided with a pair of finger slots disposed in an area that employs peripherally offset weighting to minimize torque forces that would normally be generated as the ball moves through the swing plane wherein, the exterior surface of the ball is further provided with cushioned positioning elements to maintain the user's thumbs in the proper orientation during the repetitive plane movements.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
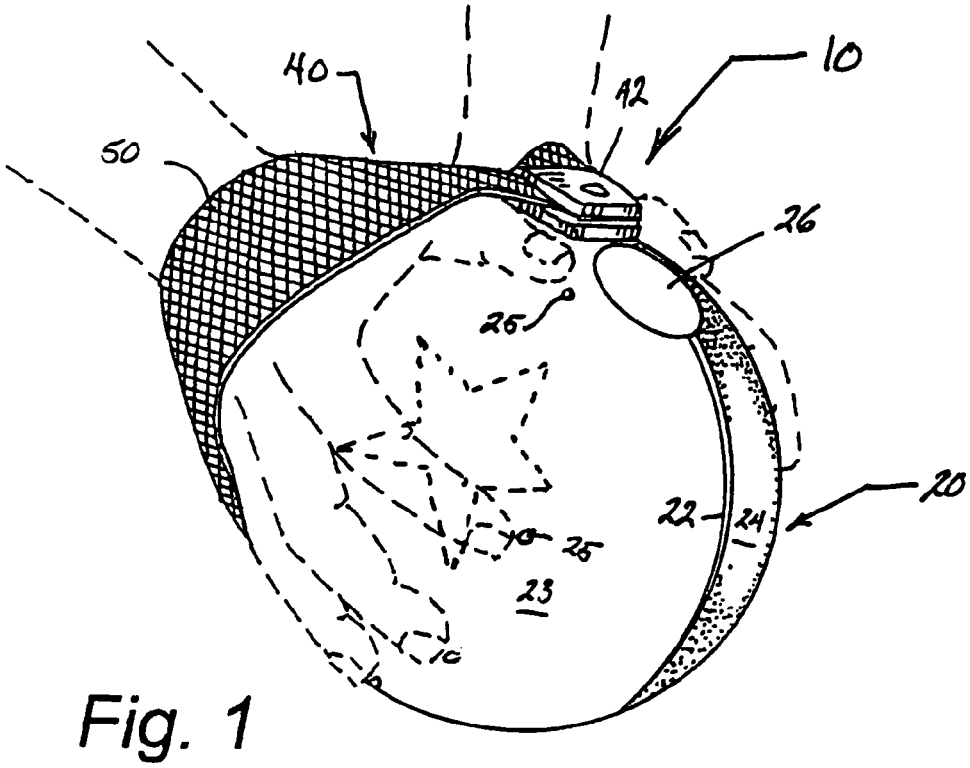
FIG. 1 is a perspective view showing the position of the user's hands from one side of the swing training device.

As can be seen by reference to the drawings, and in particular to FIG. 1, the golf training device that forms the preferred embodiment of the present invention is designated generally by the reference number 10. The swing training device 10 comprises a generally spherical member 20 and a hand grasping member 40 wherein, both of these structural components will now be described in seriatim fashion.

As shown in FIGS. 1,2,4, and 5, the generally spherical member 20 comprises a ball 21 having either a solid or hollow interior and preferably fabricated from a material having a high coefficient of friction such as hard rubber or the like.

Figure 2:
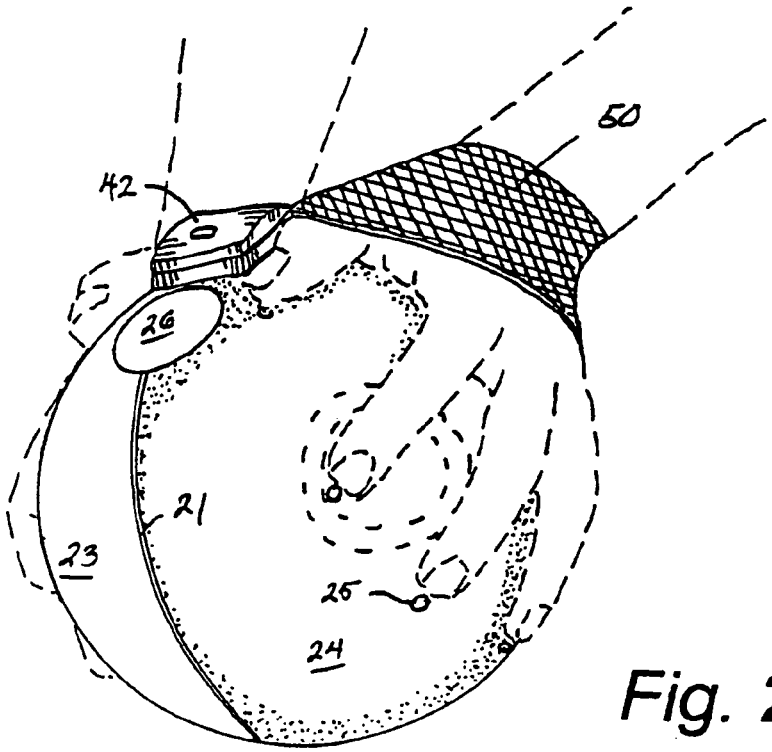
FIG. 2 is a perspective view showing the position of the user's hands from the other side of the swing training device.

In addition, the exterior surface of the ball 21 is provided with a variety of visual indicia such as a meridian line 22 that visually divides the ball 21 into two distinct hemispheres 23 24 wherein, the hemispheres 23 24 can be distinguished from one another by other visual indicia such as different solid color schemes and/or distinctive symbols depicted in phantom in FIGS. 1 and 2.

Figure 5:
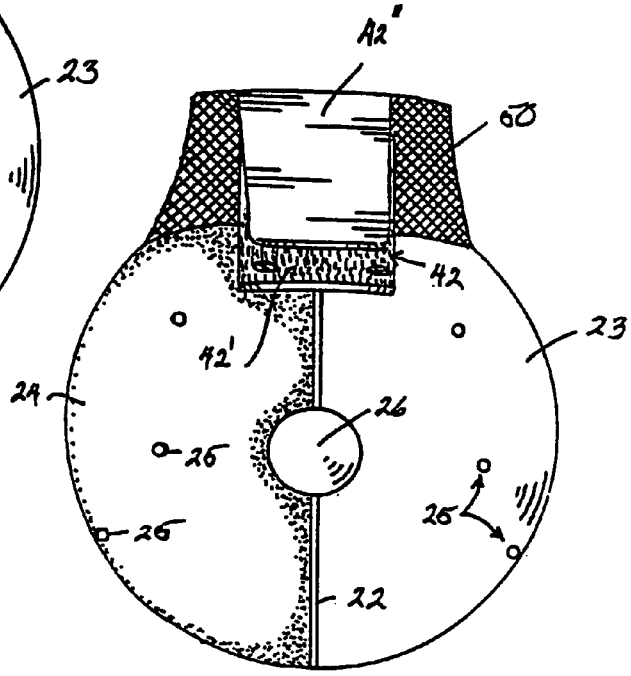
FIG. 5 is a right side elevation view of the releasable anchor of the hand grasping member in its closed position.

Furthermore, as can best be seen by reference to FIGS. 5 and 6, each of the hemispheres is also provided with a plurality of finger registration indicia 25 in the form of dots, or the like, and the meridian line 22 is also provided with an enlarged circular visual target 26 the purpose and function of which will be explained in greater detail further on in the specification.

Turning now to FIGS. 4 through 8, it can be seen that the hand engaging member 40 comprises a pair of anchor elements 41 42 secured to the ball 21 and disposed at spaced locations along the meridian line 22 wherein, one of the anchor elements 42 is disposed proximate to but spaced from the enlarged visual target 26 and further comprises an elongated resilient strap element 50.

In the preferred embodiment of the invention illustrated in the drawings, the intermediate portion 51 of the strap element 50 is fixedly secured to an anchor element 41 which is fixedly secured to the ball 21 and the opposite ends 52 53 of the strap element 50 are releasably engaged by the hinged anchor element 42.

Figure 6:
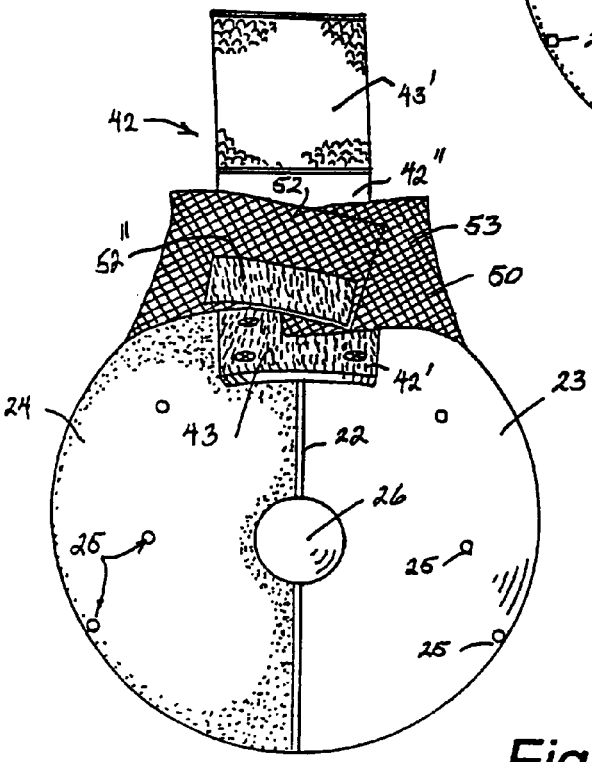
FIG. 6 is oriented the same as FIG. 5 and depicts the releasable anchor element in its open position.
Figure 7:
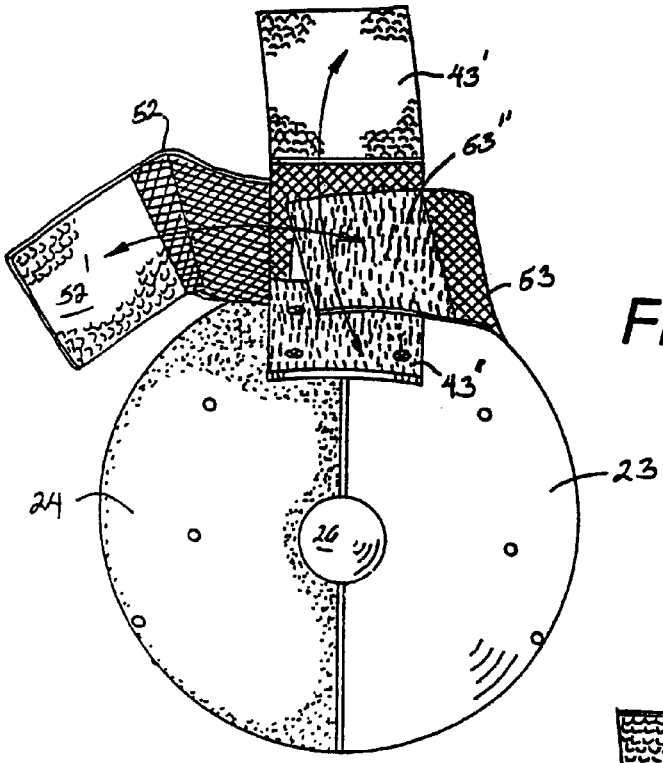
FIG. 7 is similar to FIG. 6, but depicts one end of the resilient strap element detached from the releasable anchor element.
Figure 8:
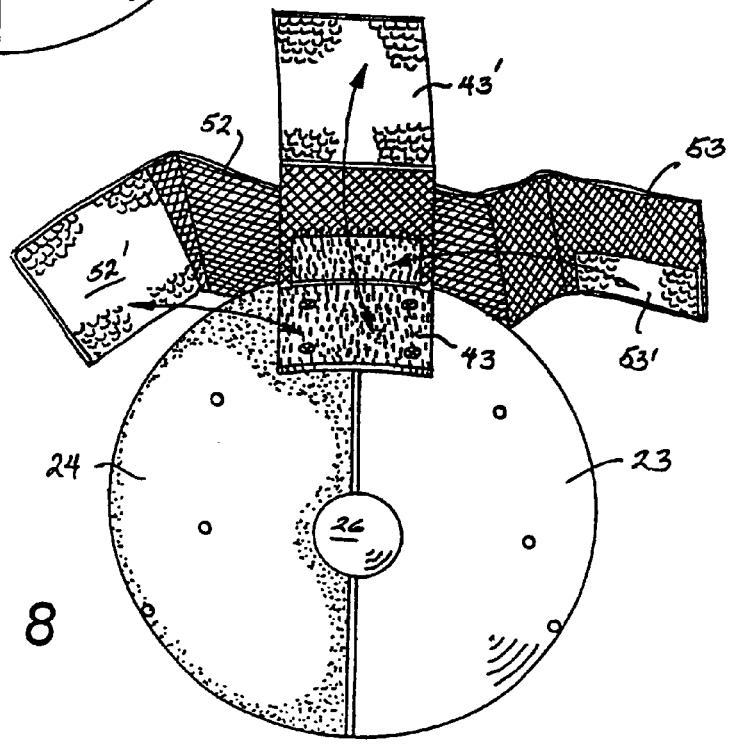
FIG. 8 is similar to FIG. 7 but shows both ends of the strap element disengaged from the releasable anchor element.

Furthermore, the hinged anchor element 42 has a fixed portion 42' and a movable portion 42" wherein, the opposed surfaces of the portions 42' and 42" are provided with cooperating hook and loop fasteners 43 43' shown in FIGS. 6 through 8.

As can also be appreciated by reference to FIGS. 6 through 8, one end 52 of the strap element 50 has an interior face provided with the loop component 52' and an exterior face provided with the hook component 52" of a cooperating hook and loop fastener, while the other end 53 of the strap element 50 also has an interior face provided with the loop component 53' and an exterior face provided with the hook component 53" of a hook and loop fastener.

The adjustment of the hand engaging member 40 occurs by reversing the sequence depicted in FIGS. 5 through 8 wherein, the loop component 52' is first engaged with the hook component 43 followed by the loop component 53' engaging either the hook component 52" and/or the hook component 43. Then the looped component 43' may be brought into contact with one or more of the hook components 43 52" and 53".

Figure 3:
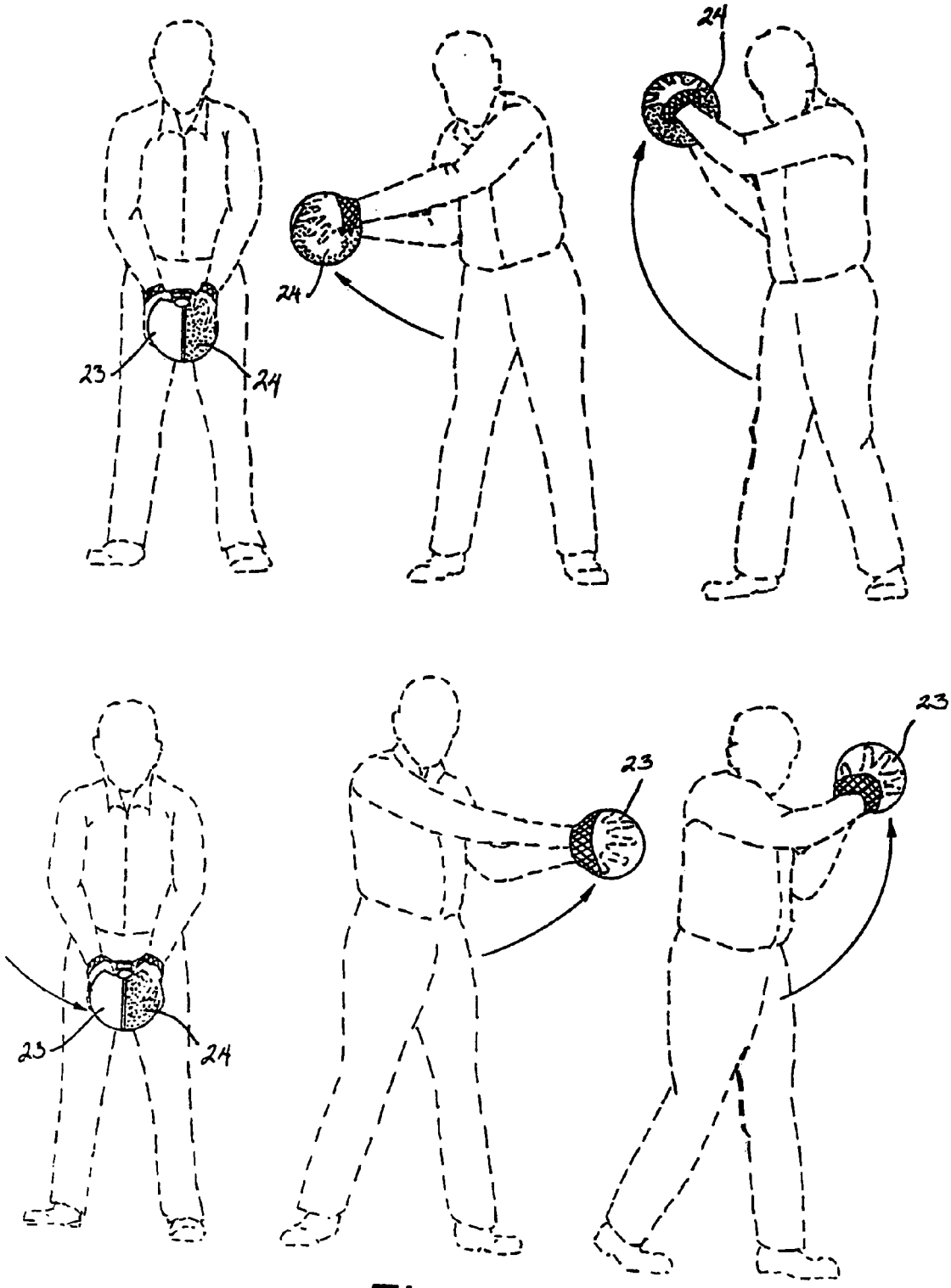
FIG. 3 is a sequential view showing the position of the training device during all phases of the golf swing.
Figure 4:
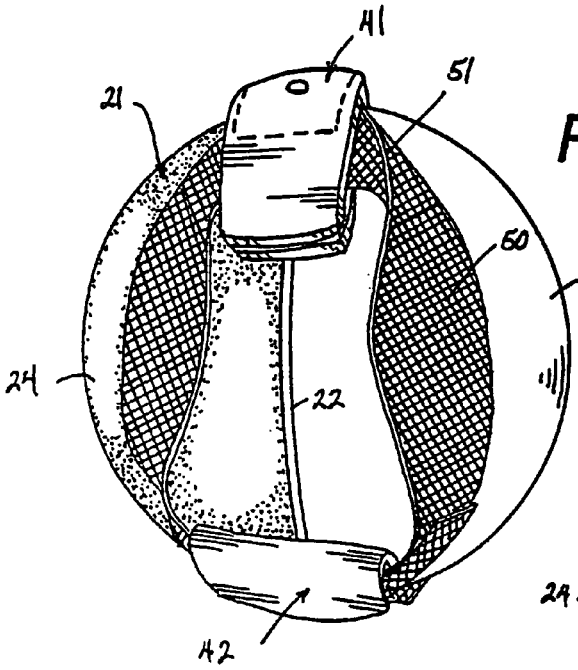
FIG. 4 is a top view of the hand grasping member and the spherical member.

The method of employing the training device 10 is depicted in FIGS. 1 through 3 wherein, the user inserts both his/her hands beneath the resilient strap element 50 and beyond the knuckles on opposite sides of the meridian line 22 such that the user is looking downwardly upon the enlarged visual target 26 and the thumbs and fingers are aligned with the finger registration indicia 23 on both hemispheres 23 24.

In the sequential swing illustration depicted in FIG. 3, the user is a right handed golfer wherein, the left hemisphere 24 is darker in color than the right hemisphere 23. To initiate the strengthening and training swing sequence, the user inserts his or her hands beneath the strap element 50 to maintain the hand grasping member 40 in light frictional contact with the ball 50.

The user then bends his/her knees slightly and leans their upper torso forward into the normal golf ball addressing position. With the user's attention focused on the enlarged visual target 26, the user begins their backswing motion which progressively increases their sight picture of the darker colored hemisphere 24 until the lighter colored hemisphere 23 is completely obscured well into the backswing arc.

Then as the user's downswing begins, the lighter hemisphere 23 will once again become partially visible as the swing arc approaches the imaginary point of impact whereupon, the lighter colored hemisphere 23 will fill the user's field of vision during the follow through and release phases of the swing plane.

At this juncture, it should also be noted that given the fact that the average weight of the spherical member 20 will be in the four to six pound range, the weight and momentum of the ball will literally force the user to follow through with the proscribed hip turn at the proper point in the swing sequence.

The essential feature of the invention, in effect, is the passive gripping of the hands by the strap element 50. This is critical in that during the forward swing progression, where the benefit of the exercise is carried out to its fullest, the exerciser need not exert an opposite force upon the ball in order to maintain its grasp. That is, as the user's hands move through the main swing movement, the exerciser's concentration can be on the manner in which his or her arms, shoulders, and back are positioned during the exercise rather than having to concentrate upon grasping the ball, in effect, forcing the hands against the ball in opposition to the swing movement. If such opposite action were necessary, then the muscles of the left side of the golf exerciser, assuming a right-handed swing from right to left, would be forced to flex inwardly to maintain a positive grasp of the ball which would detract from the exercise. In addition, the passive attachment of the hands to the ball enables the swing to be carried out at a much fuller extend of the forward swing then would be possible without such attachment.

Turning now to FIGS. 9 through 12, it can be seen that in the alternate version of the preferred embodiment, the swing training device 10' also comprises a generally spherical member 20' in the form of a hollow ball 21' having a pair of elongated slots 27 27 which are disposed on the opposite sides of, and angled toward the meridian line 22' that visually divides the ball 21' into two different hemispheres 23' 24'.

In addition, the meridian line 22' is further provided with an enlarged visual target 26' wherein, the meridian line 22', the hemispheres 23' 24' and the visual target 26' of the alternate version of the swing training 10' serve the same purpose and function as their like numbered counterparts in the preferred embodiment of the swing training device 10.

Figure 9:
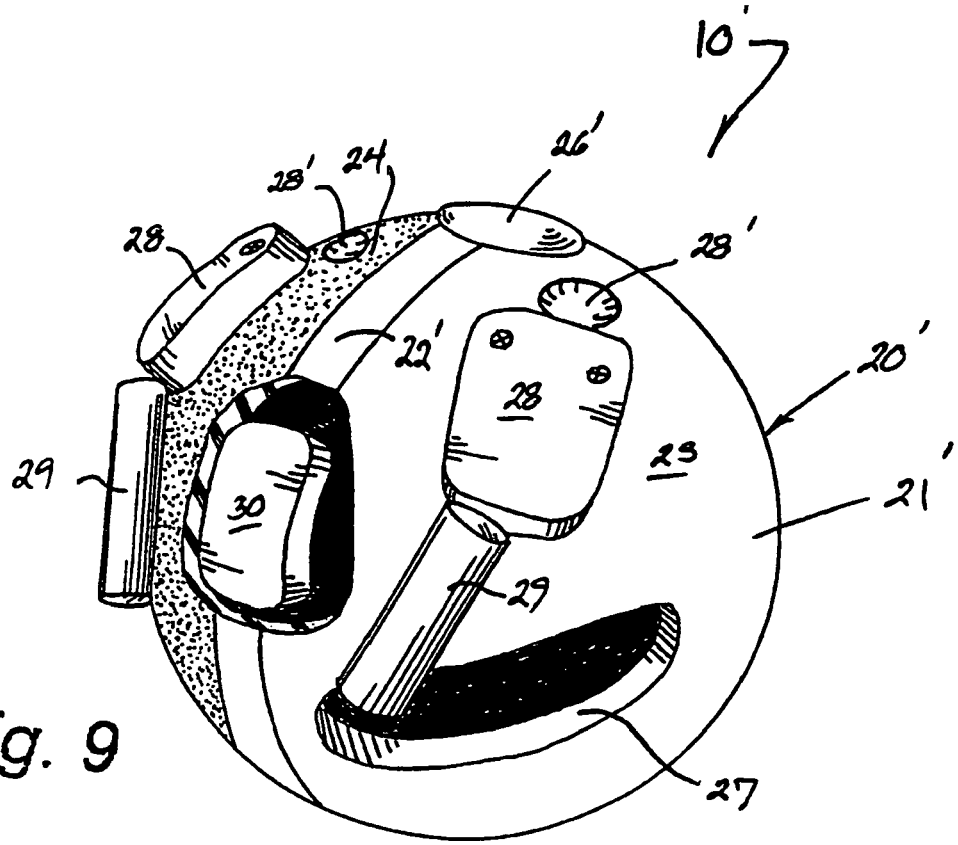
FIG. 9 is a partially cut away perspective view of the alternate version of the preferred embodiment.
Figure 10:
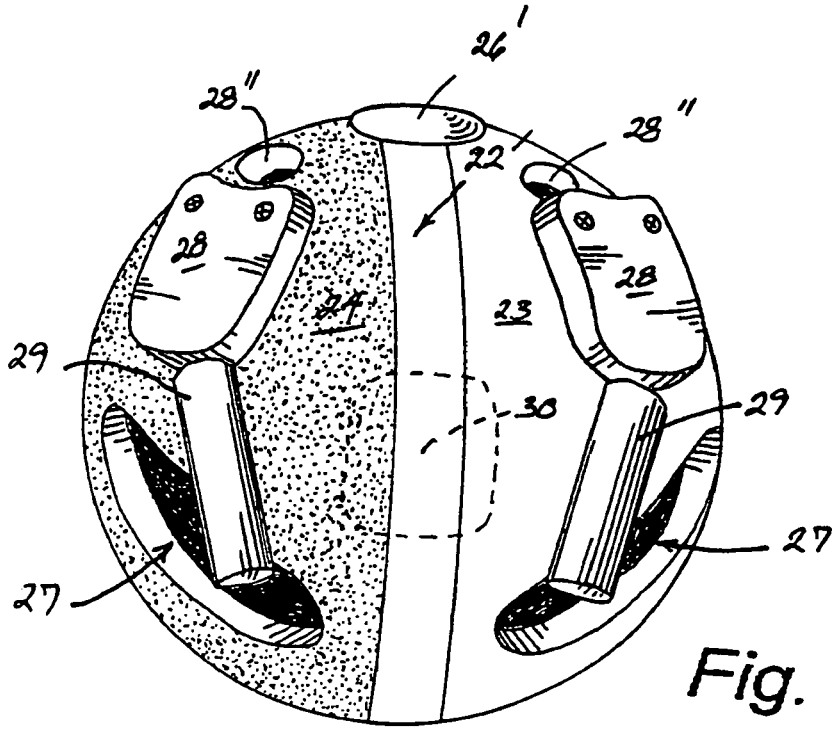
FIG. 10 is a generally front elevation view of the alternate version.
Figure 11:
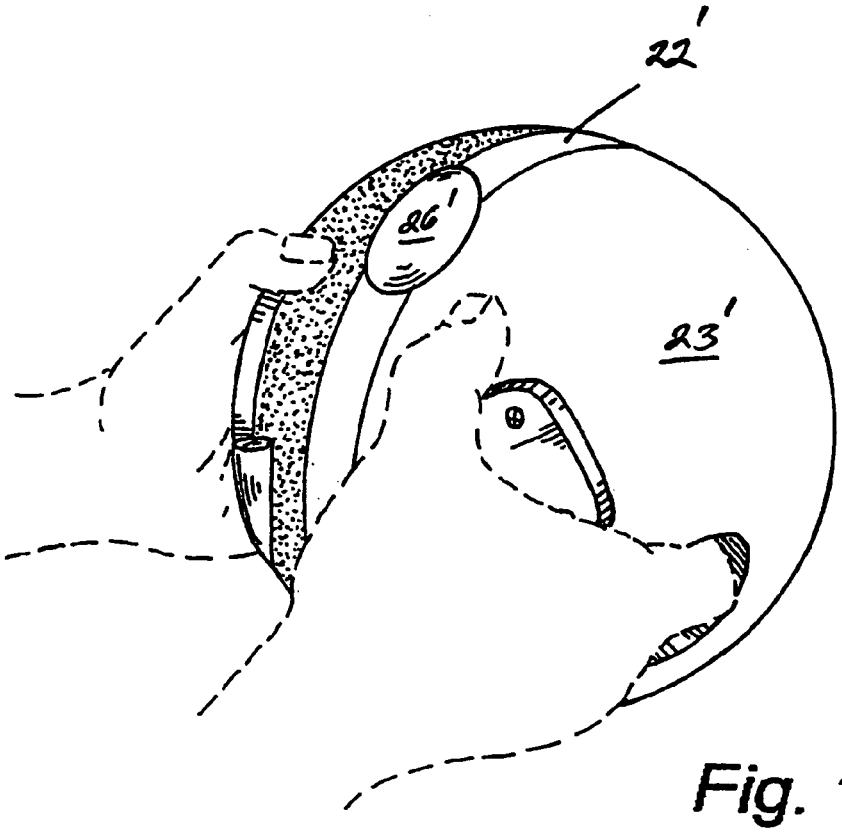
FIG. 11 is a right side perspective view showing the user grasping the alternate version.
Figure 12:
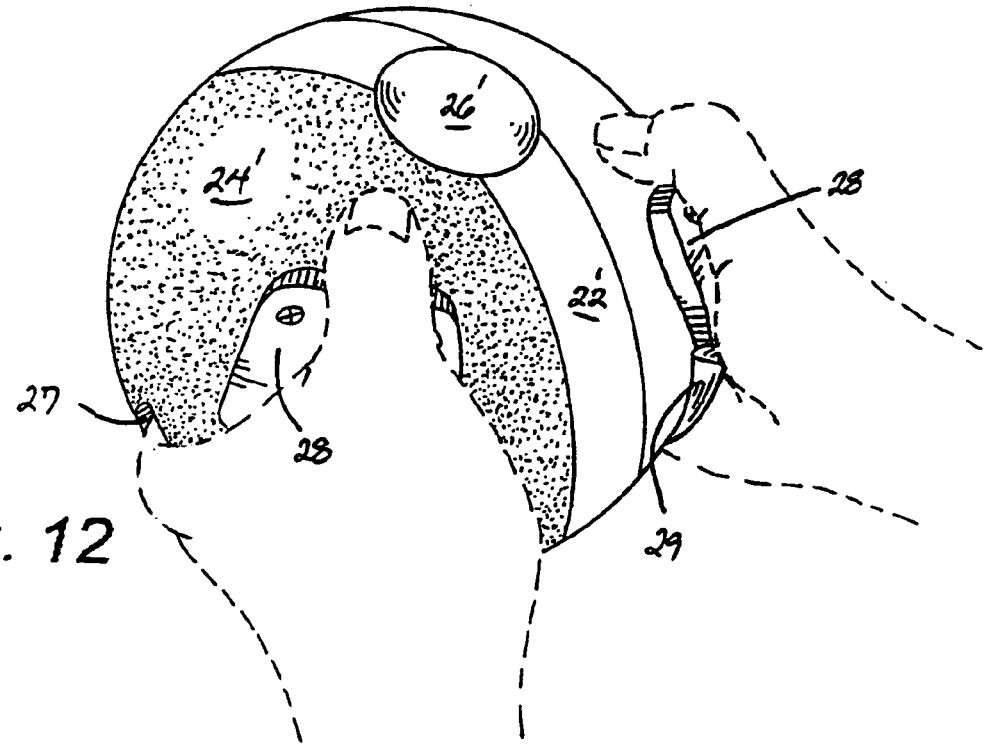
FIG. 12 is a left side perspective view similar to FIG. 11.

As can best be seen by reference to FIGS. 9 and 10, the exterior surface of the hollow ball 21' is further provided with a pair of thumb pads 28 28 and a pair of generally cylindrical palm pad cushions 29 29 that will align the user's thumbs on the opposite sides of the meridian line 22' when the user's fingers are inserted through the slots 27 27 and into the hollow core 31 of the ball 21' as depicted in FIGS. 11 and 12.

Still referring to FIGS. 9 and 10, it can be seen that this invention also contemplates the use of thumb recesses 28' 28' or thumb holes 28" 28" adjacent the thumb pads 28 28 to enhance the user's grip on the hollow ball 21'.

While the slots 27 27, the thumb pads 28 28, and the palm pad cushions 29 29 represent the most visible structural distinctions between the preferred embodiment 10 and the alternate version 10' the most significant distinction resides in the peripheral weighting of the hollow core 31 of the ball 21'.

As can be seen by reference to FIGS. 9, and 12 through 14, the hollow core 31 is provided with a peripheral weighting either in the form of an independent weighted insert 30 or by an increased thickness of the core material 32 which defines the hollow core 31.

It should also be noted that the offset peripheral weighting is centered around the meridian line 22' at a point proximate the opposed thumb pads 28 28 and/or the finger slots 27 27 such that the extra weight is focused in the vicinity of the user's hands and wrists to minimize the torquing effect of the ball 21' as it is brought through the basic swing plane motion illustrated in FIG. 3.

Some other noticeable differences between the preferred embodiment and the alternate version are as follows: training device 10 involves passive engagement with the exterior surface of the ball 21 whereas, training device 10' requires active engagement with both the interior and exterior of the ball, and, training device 10 employs a uniformly weight distributed solid or hollow core ball 21 whereas, training device 10' employs a peripherally offset weighted ball 21'.

Figure 13:
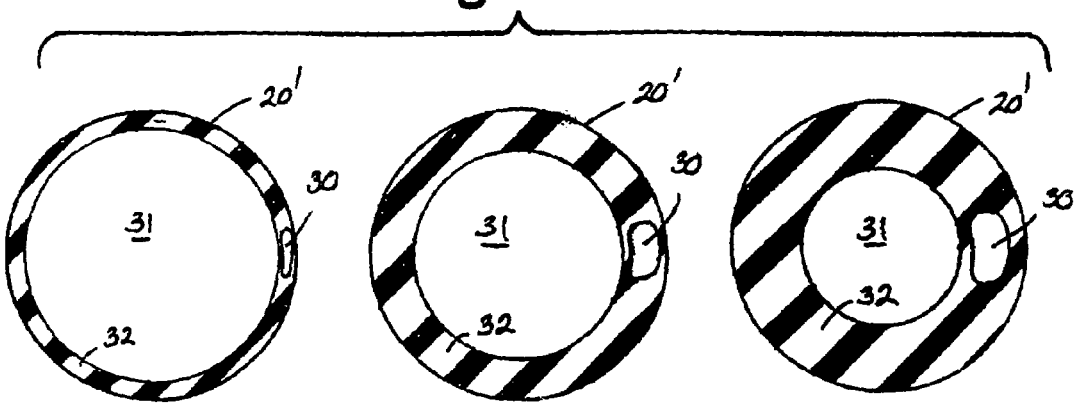
FIG. 13 is a cross-sectional view taken through a variety of different weight uniform wall thickness spherical members.
Figure 14:
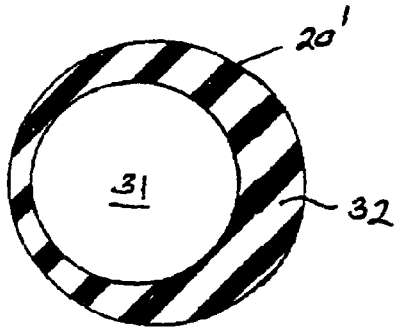
FIG. 14 is a cross-sectional view of an alternate version of the peripherally weighted spherical member.

Furthermore, as depicted in FIG. 13, the overall weight of the hollow ball 21 or 21' may be varied by increasing the thickness of the core material 32 so that different weight balls 21 21' maybe employed by golfers having different skill levels, or as depicted in FIG. 14, the thickness of the core material 32 is varied to produce the peripheral weighting.

Figure 15:
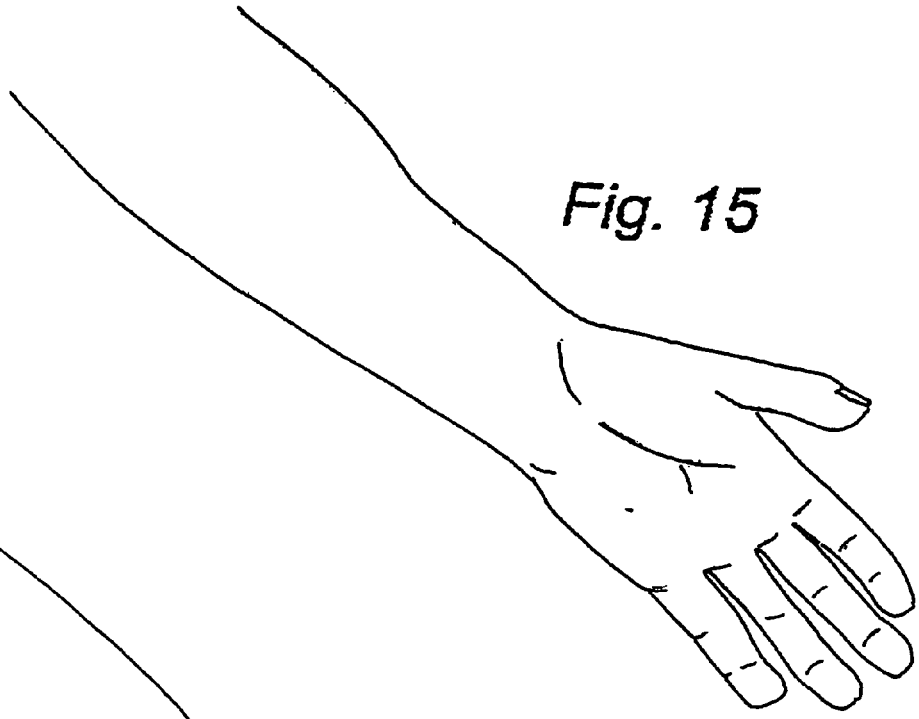
FIG. 15 shows the normal hand position when using a uniformly weighted spherical member; and, FIG. 16 shows the canted hand position resulting from the use of a periphery weighted spherical member.
Figure 16:
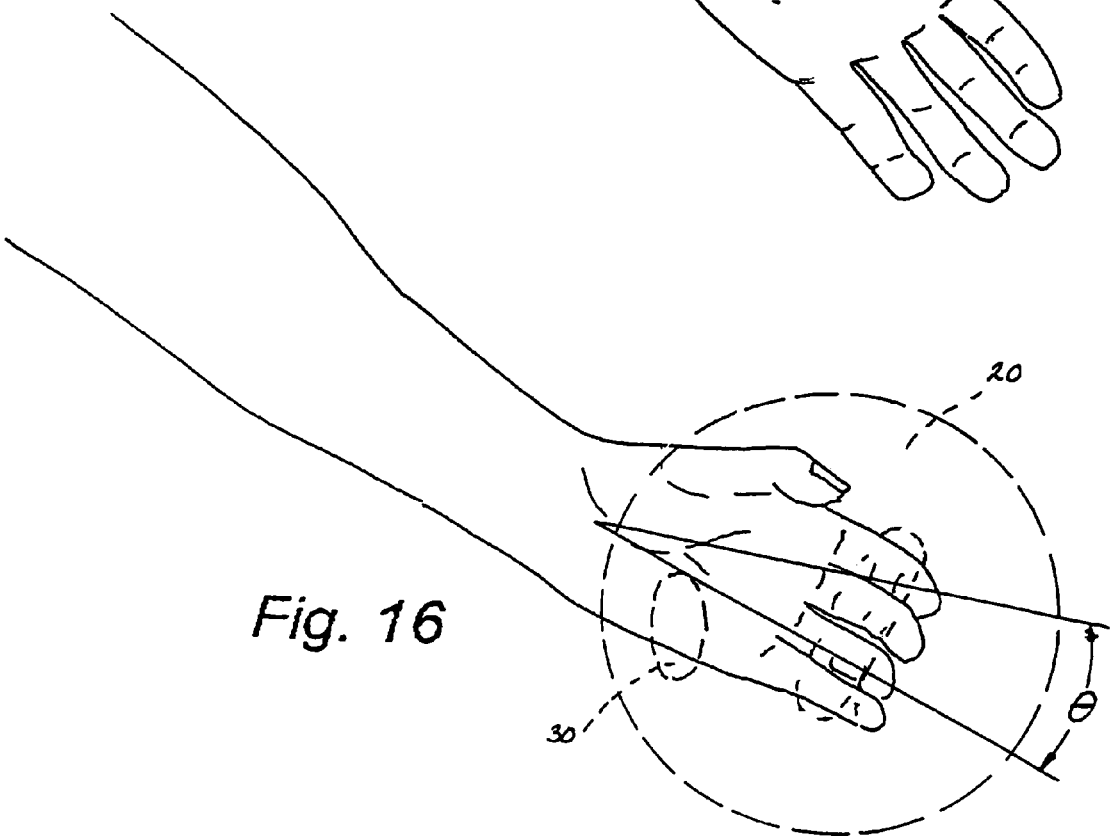

As shown in FIG. 15, when using a uniformly weighted spherical ball 21, the user's hands are naturally aligned along the longitudinal axis of their forearms. However, when the user grasps the peripherally weighted spherical ball 21', the offset placement of the weighted insert 30 causes the user's hands to be "cocked" at an angle of "$\ominus$" which ranges between 15° and 45°.

This "cocking" forces the user's hands toward their belt buckle at the beginning of the swing at the proper angular orientation to replicate an "inside/out" golf swing as the user moves the ball through the swing plane.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A sports swing training device for strengthening the muscle groups employed in the proper swing and enhancing muscle memory wherein, the device comprises:

a generally spherical member comprising a hollow ball having an outer surface provided with visual indicia that divides the generally spherical member into two hemispheres divided by a meridian line wherein said hollow ball is provided with a pair of elongated slots, each of the pair of slots being dimensioned to receive fingers on one of a user's hands, and being disposed on opposite sides of and angled toward the meridian line.

2. The training device as in claim 1, wherein said hollow ball is provided with offset weighting.

3. The training device as in claim 2, wherein the offset weighting is accomplished with a weighted insert.

4. The training device as in claim 2, wherein the offset weighting is accomplished with increased core material thickness in a selected area.

5. The training device as in claim 2, wherein the outer surface of the ball is provided with a pair of thumb pads.

6. The training device as in claim 5, wherein the outer surface of the ball is further provided with a pair of cylindrical palm pad cushions attached to and extending above the outer surface of the ball.

7. The training device as in claim 5, wherein each thumb pad is disposed proximate to but spaced from one of said slots.

8. The training device as in claim 5, wherein each of the thumb pads is associated with a thumb recess.

9. The training device as in claim 5, wherein each of the thumb pads is associated with a thumb aperture.

10. The training device as in claim 1, wherein the ball is further provided with an enlarged visual target.

11. The training device as in claim 1, wherein said visual indicia comprises different colors.

* * * * *